US006341462B2

(12) United States Patent
Kiik et al.

(10) Patent No.: US 6,341,462 B2
(45) **Date of Patent: *Jan. 29, 2002**

(54) ROOFING MATERIAL

(75) Inventors: Matti Kiik, Richardson; Dan LaVietes, DeSoto; Michael L. Bryson, Ennis; Timothy Harve Lock, Waxahachie, all of TX (US)

(73) Assignee: Elk Corporation of Dallas, Dallas, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/227,473

(22) Filed: Jan. 8, 1999

(51) Int. Cl.[7] ..... E04D 1/00; E04D 1/26

(52) U.S. Cl. ..... 52/518; 52/557; 428/430; 428/480; 428/481; 428/913; 442/331; 442/333; 442/367

(58) Field of Search ..... 52/518, 557; 428/354, 428/430, 480, 481, 913; 442/331, 333, 367

(56) References Cited

U.S. PATENT DOCUMENTS

| | | | | |
|---|---|---|---|---|
| 3,813,280 | A | | 5/1974 | Olszyak et al. |
| 3,973,369 | A | | 8/1976 | Smith |
| 3,992,842 | A | | 11/1976 | Haage et al. |
| 4,023,321 | A | | 5/1977 | Smith |
| 4,035,544 | A | | 7/1977 | Iwasaki et al. |
| 4,039,706 | A | | 8/1977 | Tajima et al. |
| 4,050,209 | A | | 9/1977 | Barker et al. |
| 4,063,395 | A | | 12/1977 | Stewart et al. |
| 4,102,107 | A | | 7/1978 | Barker et al. |
| 4,141,187 | A | | 2/1979 | Graves |
| 4,188,763 | A | | 2/1980 | Thiis-Evensen |
| 4,195,461 | A | | 4/1980 | Thiis-Evensen |
| 4,219,603 | A | | 8/1980 | Thun |
| 4,226,069 | A | | 10/1980 | Hindis |
| 4,315,392 | A | | 2/1982 | Sylvest |
| 4,357,377 | A | | 11/1982 | Yamamoto |
| 4,395,306 | A | * | 7/1983 | Killat ..... 162/156 |
| 4,405,680 | A | | 9/1983 | Hansen |
| 4,459,788 | A | | 7/1984 | Bockwinkel et al. |
| 4,472,243 | A | | 9/1984 | Bondoc et al. |
| 4,491,617 | A | | 1/1985 | O'Connor et al. |
| 4,539,254 | A | | 9/1985 | O'Connor et al. |
| 4,610,902 | A | | 9/1986 | Eastman |
| 4,617,229 | A | | 10/1986 | Larsson et al. |
| 4,636,414 | A | | 1/1987 | Tajima et al. |
| 4,668,315 | A | | 5/1987 | Brady et al. |
| 4,683,165 | A | * | 7/1987 | Lindemann et al. ..... 428/290 |
| 4,729,814 | A | | 3/1988 | Jennus et al. |
| 4,745,032 | A | | 5/1988 | Morrison |
| 4,749,606 | A | | 6/1988 | Lempereur |
| 4,762,744 | A | | 8/1988 | Woiceshyn et al. |
| 4,780,350 | A | | 10/1988 | O'Connor et al. |
| 4,784,897 | A | | 11/1988 | Brands et al. |
| 4,848,057 | A | | 7/1989 | MacDonald et al. |
| 4,871,605 | A | | 10/1989 | Pagen et al. |
| 4,873,303 | A | | 10/1989 | Blackwood et al. |
| 4,875,321 | A | | 10/1989 | Rohner |
| 5,052,162 | A | | 10/1991 | Bush et al. |
| 5,108,831 | A | | 4/1992 | Green |
| 5,195,290 | A | | 3/1993 | Hulet |
| 5,334,648 | A | * | 8/1994 | Drews et al. ..... 524/512 |
| 5,347,785 | A | | 9/1994 | Terrenzio et al. |
| 5,439,726 | A | | 8/1995 | Woiceshyn |
| 5,474,838 | A | | 12/1995 | Callaway et al. |
| 5,569,430 | A | | 10/1996 | Callaway et al. |
| 5,571,596 | A | | 11/1996 | Johnson |
| 5,822,943 | A | | 10/1998 | Frankoski et al. |
| 5,851,933 | A | * | 12/1998 | Swartz et al. ..... 442/180 |
| 5,965,257 | A | | 10/1999 | Ahluwalia |
| 5,965,638 | A | | 10/1999 | Heine |

FOREIGN PATENT DOCUMENTS

| | | |
|---|---|---|
| AU | 8777624 | 3/1988 |
| EP | 0260494 | 3/1980 |
| GB | 2015925 | 9/1979 |
| GB | 2032988 | 5/1980 |
| WO | 9900338 | 1/1999 |
| WO | 9913154 | 3/1999 |
| ZA | 8706386 | 5/1988 |

* cited by examiner

*Primary Examiner*—Daniel Zirker
(74) *Attorney, Agent, or Firm*—Baker Botts LLP

(57) ABSTRACT

Roofing material is improved by adhering to at least part of its lower surface a backing material consisting essentially of a fiber component and a binder component. Acceptable fibers include polyester, glass and woodpulp. In a preferred embodiment, the fiber component is a mixture of polyester and glass fibers and the binder is a latex binder.

9 Claims, No Drawings

ROOFING MATERIAL

BACKGROUND OF THE INVENTION

This invention relates to roofing material, and in particular to roofing shingles, having a novel backing which renders the material pliable and imparts improved characteristics such as resistance to damage from hail.

Roofing material has an upper surface intended to be exposed to weather and a lower surface facing in the direction opposite to the upper surface. Traditionally, the lower surface or back of roofing material such as shingles has been covered with finely ground mineral material (fines) so that the asphalt backing does not adhere to contiguous roofing material when packaged for transport and storage. Such finely divided materials include mica flakes, copper slag, coal slag, sand, talc and silica dust.

In many regions the roofing materials on buildings, particularly the shingles on residential dwellings, are damaged by hail. The damage is caused by the impact of the hail stones on shingles resulting in cracking, tearing, snapping or imperceptible damage to the shingles' structure which can render the shingles less resistant to the elements of wind, rain, snow and ice. Frequently, such damage requires the costly replacement of roofing materials to prevent the elements from entering into the building. Accordingly, it is an object of the invention to provide more energy absorbing roofing materials, particular shingles, which better absorb the impact of hail and are therefore less susceptible to damage during hail storms.

SUMMARY OF THE INVENTION

In accordance with the invention, roofing materials such as shingles are improved by adhering to at least a part of their back surface or lower surface a backing material which may be made of polyester fibers, woodpulp, glass fibers, cotton fibers, wool fibers, carpet material, nylon fibers, rayon fibers, acrylic fibers, polyolefin fibers, polypropylene fibers and recycled plastics fibers, binder material, crosslinking agents and mixtures thereof. In a preferred embodiment, the backing material is a mat consisting essentially of a mixture of glass fiber, polyester fiber and a latex binder.

DETAILED DESCRIPTION

Asphalt roofing materials, including shingles, are manufactured by following conventional procedures. Bituminous prepared roofing has heretofore been extensively manufactured using as a base a fibrous web such as a sheet of roofing felt or fiberglass mat, impregnating the fibrous web with a bituminous material and coating one or both surfaces of the impregnated web with a weather-resistant bituminous coating material. The bituminous coating material usually contains a mineral filler such as slate flour or powdered limestone. Sometimes one or more fibrous sheets are laminated with one or more bituminous layers. Usually there is applied to the bituminous coating on the surface intended to be exposed to the weather a suitable granular material such as slate granules or mineral surfacing. Finely divided materials such as mica flakes, talc, silica dust or the like may be made adherent to the non-weather exposed surface of the roofing shingle to prevent sticking of the adjacent layers of the roofing material in packages.

In the present invention, the fines on the back of roofing material are replaced with a backing material or mat that renders the product more energy absorbent than it otherwise would be. In a preferred embodiment, the mat includes a non-woven layer of wet laid polyester staple fibers. However, a woven polyester mat may also be employed. Polyester mats are resistant to punctures and tears and thus, their inclusion on the backs of roofing materials renders the materials less susceptible to damage from hail.

The backing material is adhered to the face of the back of the shingle in lieu of fines, granules or other standard backing material at the slating drum stage of conventional shingle manufacturing. The inventive shingles are manufactured using a standard line where asphalt coats the moving web and mineral granules are dropped on the upper surface of the hot asphalt coated web. In accordance with the invention, a roll of mat enters from the back side of the line at 90°. The roll runs through an unwind stand, a splicer, an accumulator, and directional changing rolls to feed the mat under the slating drum. Alternatively, the mat may enter from the top and be fed directly to the back of the slating drum, in essence replacing the back surfacing equipment normally utilized. The application technique is similar to the current industry technique of applying release tape to the back of the shingle at the slating drum.

Polyester melts at approximately 350° . and the asphalt which coats the moving web in shingle manufacturing is typically about 400° F. Thus, the polyester fuses to the back of the shingle. However, because cooling occurs rapidly, the back side of the polyester mat facing away from the shingle remains intact.

Shingles made with the inventive polyester backing have better tear strength than standard shingles backed with finely divided granules. The inventive shingles are less susceptible to machine breaks and fractures and tears during field application, i.e. they tolerate installation abuse. Further, the inventive shingles pass impact tests despite their light product weight. Moreover, they demonstrate increased nail holding ability and maintain structural integrity at elevated temperatures. Also, the mat fused to the back of the shingle is less likely to crack than the asphalt coating. Thus an enhanced impact resistant seal against water penetration is provided. Additionally, the mat adheres readily to the sealant (usually a compounded bituminous material such as those disclosed in U.S. Pat. No. 4,559,267) superposed on at least some portion of the roofing material to prevent blow offs.

The inventive backing may be applied to any design or formulation of roofing material such as built up roofing materials, roll roofing and modified roll products, but it is particularly effective as shingle backing. As heretofore noted, a variety of materials may be employed in providing the backing of the inventive roofing materials. Such backing material, which may provide partial or full coverage of the lower surface of the shingles, enables the shingles to demonstrate enhanced physical properties even though the internal composition of the shingle remains unchanged. Regarding handlability, the exposed portion of the inventive shingle feels more substantial compared to the conventional product. The inventive roofing material is pliable at cold temperatures but not limp at hot temperatures.

EXAMPLE I

In accordance with the invention, backing material was prepared by combining fiber and binder such that the fiber component comprised 78% by weight of the material and the binder component comprised 22% by weight of the material. However the fiber component may comprise from about 65% to about 92% of the backing material and the binder component may comprise from about 35% to about 8% of the backing material. Elk's Corporation standard polyester blend containing equal weights of 1.5 denier 0.25 inch and 0.50 inch polyester fiber comprised 90% of the fiber component and woodpulp made up the remaining 10%. The binder component was approximately 89.5% BF Goodrich HYCAR 26138 acrylic copolymer latex binder, approximately 10% CYMEL 373 methoxymethylmelamine crosslinking agent which may be obtained from Cytec Industries of West Patterson, N.J. and approximately 0.5% citric acid. Polyester fibers may comprise from about 70% to about 100% of the fiber component and woodpulp may comprise from about 0% to about 30% of the fiber component. A binder material, such as a latex binder, may comprise from about 83% to about 100% of the binder component, crosslinking agent may comprise from about 0% to about 15% of the binder component and citric acid may comprise from about 0% to about 2% of the binder component.

EXAMPLE II

Having learned from unrelated work that 15 denier 1.50 inch polyester fiber results in increased mat tear strength, it was thought that a major portion of the standard polyester fiber blend could be replaced with less costly glass fiber if a low percentage of 15 denier 1.50 inch polyester were added to maintain tear strength. Additionally, it was believed that such a fiber formulation would require less binder component and a lower cost binder material.

Several formulas were evaluated in laboratory handsheets. Larger diameter glass fibers provided lower costs and better mat tear strength, but increased mat porosity resulted in unacceptable penetration of hot asphalt through the mat. A 1.05 lb. handsheet mat containing a furnish of 60% 0.50 inch H-9501 glass fiber obtained from Owens Corning, 30% standard polyester blend obtained from Trevira and 10% 15 denier 1.50 inch polyester obtained from Trevira combined with Rohm & Haas RHOPLEX GL-618 latex binder was found to provide the most favorable strength: penetration: cost balance. The fiber component comprised about 82% of the backing material and the binder component was about 18%. Polyester fibers may comprise from about 0% to about 100% of the fiber component and glass fibers may comprise from about 100% to about 0% of the fiber component. Although a crosslinking agent and citric acid were not included in this example, their inclusion may be appropriate in certain glass fiber/polyester formulations depending on the desired tensile and tear strengths of the product. In such formulations, binder material may comprise from about 83% to about 100% of the binder component, crosslinking agent may comprise from about 0% to about 15% of the binder component and citric acid may comprise from about 0% to about 2% of the binder component.

Experimental data obtained for Example I, Example II and a standard laminated shingle product sold by Elk are provided in Table I below:

TABLE I

| | Mat | | Shingle | | |
|---|---|---|---|---|---|
| | Example I | Example II | Example I | Example II[c] | Standard Product |
| Basis Weight (lb/sq) | 1.05 | 1.09 | | | |
| Thickness (mil) | 13 | 23 | | | |
| Frazier Porosity (cfm/ft$^2$) | 268 | 638 | | | |
| Tensile 3"(lb) MD & CD Avg. | 57 | 58 | | | |
| MD | | | 119 | 113 | 87 |
| CD | | | 59 | 67 | 48 |
| Hot Wet Tensile (3") 180° F. MD | 36 | 51 | | | |
| Elmendorf Tear (g) | | | | | |
| MD & CD | 385 | 356 | | | |
| MD | | | 1653 | 1547 | 1144 |
| CD | | | 2222 | 2335 | 1571 |
| Taber Stiffness (g-cm) MD & CD | 57 | 64 | | | |
| Binder Content (%) | 22[a] | 16[b] | | | |

[a]Production standard binder content.
[b]Measured from L.O.I. (loss on ignition) minus polyester content.
[c]Experimental shingle coupons were prepared in lab with production 1.4 lbs./square mat and experirnental handsheets.

Table II below provides a relative comparison between Elk's standard P2 shingle product (for which data are represented in Table I), Elk's heavier standard Wisconsin P2 shingle and two inventive Wisc. P2 shingles of the present application, one made with a 1.05 lb./square backing material of Example I and the other made with a 1.25 lb./square backing material of Example I. Backing material adhered to roofing material in accordance with this invention may range from 0.50 lb./sq. to 5.0 lb/sq. Elk's standard P2 shingle is offered as a control with all values shown as 1. The values presented for the other products are all shown as relative to the P2 shingle control. Thus, inventive Wisc. P2 with a 1.05 lb./sq. polyester based backing material has an MD (machine direction) tensile value which is 1.84 times the value of the standard P2 shingle and a CD (cross direction) tensile value which is 1.79 times the value of the standard P2 shingle. The data demonstrate that, by employing the inventive polyester based backing, superior properties were achieved relative to heavier weight products having essentially the same asphalt coating formulation.

TABLE II

| | Reg P-2 Control | Wisc. P-2 Std. | Wisc. P-2 W/1.05/lb. Polyester | Wisc. P-2 W/1.25/lb. Polyester |
|---|---|---|---|---|
| Tensile | | | | |
| MD | 1 | 1.34 | 1.84 | 1.79 |
| CD | 1 | 1.39 | 1.79 | 1.79 |
| TEAR | | | | |
| MD | 1 | 1.12 | 1.62 | 1.47 |
| CD | 1 | 1.43 | 2.02 | 1.91 |
| NAILPULL | 1 | 1.42 | 2.14 | 2.60 |
| FLEXIBILITY | | | | |
| | 1 | 1 | 1 * | 1 * |

TABLE II-continued

| | Reg P-2 Control | Wisc. P-2 Std. | Wisc. P-2 W/1.05/lb. Polyester | Wisc. P-2 W/1.25/lb. Polyester |
|---|---|---|---|---|
| DROOP | 1 | .76 | .78 | .6 |
| WT. | 226.4 lb./sq. | 262.2 lb./sq. | 237 lb./sq. | 237 lb./sq. |

* Surface cracking the same - polyester - based product will not crack or tear while handled.

It should be understood that the above examples are illustrative, and that compositions other than those described above can be used while utilizing the principles underlying the present invention. For example, other sources of fiber as well as mixtures of binders and/or crosslinking agents may be used in formulating the backing material. Moreover, the backing material may be applied to various types of roofing products.

What is claimed is:

1. In a bituminous roofing material having an upper surface intended to be exposed to weather and lower surface facing in a direction opposite to the upper surface, the improvement comprising:

a non-bituminous backing material disposed on an outer surface of said roofing material wherein said backing material has an upper surface adhered to at least part of the face of said lower surface of said roofing material and a lower surface facing in a direction opposite to the upper surface of the backing material wherein the lower surface of the backing material is not in contact with the roofing material, and wherein said backing material comprises a binder material and a component selected from the group consisting of polyester fibers, woodpulp, glass fibers, cotton fibers, wool fibers, carpet material, nylon fibers, rayon fibers, acrylic fibers, polyolefin fibers, polypropylene fibers and recycled plastics fibers, and mixtures thereof.

2. A roofing material according to claim 1 wherein said backing material is a mat consisting essentially of (a) a fiber component which is a mixture of essentially polyester fibers and glass fibers and (b) a latex binder component.

3. A roofing material according to claim 2 wherein said fiber component comprises from about 65% to about 92% of said backing material and said binder component comprises from about 35% to about 8% of said backing material.

4. A roofing material according to claim 3 wherein polyester fibers comprise from about 0% to about 100% of said fiber component and glass fibers comprise from about 100% to about 0% of said fiber component; binder material comprises from about 83% to about 100% of said binder component, crosslinking agent comprises from about 0% to about 15% of said binder component and citric acid comprises from about 0% to about 2% of said binder component.

5. A roofing material according to claim 1 wherein said backing material is a mat consisting essentially of (a) a fiber component which is a mixture of essentially polyester fibers and woodpulp and (b) a latex binder component.

6. A roofing material according to claim 5 wherein said fiber component comprises from about 65% to about 92% of said backing material and said binder component comprises from about 35% to about 8% of said backing material.

7. A roofing material according to claim 6 wherein polyester fibers comprise from about 70% to about 95% of said fiber component, woodpulp comprises from 5% to about 30% of said fiber component; binder material comprises from about 83% to about 100% of said binder component, crosslinking agent comprises from about 0% to about 15% of said binder component and citric acid comprises from about 0% to about 2% of said binder component.

8. A roofing material according to claim 1, 2, 3, 4, 5, 6 or 7 wherein said roofing material is a shingle or roll roofing material.

9. A roofing material according to claim 1 wherein said backing material further comprises a crosslinking agent.

* * * * *

UNITED STATES PATENT AND TRADEMARK OFFICE

CERTIFICATE OF CORRECTION

PATENT NO. : 6,341,462 B2
DATED : January 29, 2002
INVENTOR(S) : Kiik et al.

It is certified that error appears in the above-identified patent and that said Letters Patent is hereby corrected as shown below:

Title page,
Item [75], Inventors: "Dan LaVietes" should read -- Daniel LaVietes --

Column 2,
Line 17, "350° ." should read -- 350° F. --

Column 4,
Table 1, footnote c: "experinental" should read -- experimental --

Signed and Sealed this

Eighteenth Day of February, 2003

JAMES E. ROGAN
*Director of the United States Patent and Trademark Office*